US007677023B2

(12) United States Patent
Schneider

(10) Patent No.: US 7,677,023 B2
(45) Date of Patent: Mar. 16, 2010

(54) CABLED CARBON-FIBER THREAD

(75) Inventor: Markus Schneider, Dusseldorf (DE)

(73) Assignee: Toho Tenax Europe GmbH, Wuppertal (DE)

( * ) Notice: Subject to any disclaimer, the term of this patent is extended or adjusted under 35 U.S.C. 154(b) by 549 days.

(21) Appl. No.: 11/659,832

(22) PCT Filed: Sep. 21, 2004

(86) PCT No.: PCT/EP2004/010569

§ 371 (c)(1),
(2), (4) Date: Feb. 9, 2007

(87) PCT Pub. No.: WO2006/018036

PCT Pub. Date: Feb. 23, 2006

(65) Prior Publication Data

US 2007/0193246 A1 Aug. 23, 2007

(30) Foreign Application Priority Data

Aug. 10, 2004 (DE) ..... 10 2004 038 710

(51) Int. Cl.
*D02G 3/22* (2006.01)

(52) U.S. Cl. ..... 57/236

(58) Field of Classification Search ..... 57/236, 57/243; 428/367
See application file for complete search history.

(56) References Cited

U.S. PATENT DOCUMENTS

| | | | | | |
|---|---|---|---|---|---|
| 4,520,623 | A | * | 6/1985 | Ogawa et al. | 57/236 |
| 4,714,642 | A | * | 12/1987 | McAliley et al. | 428/113 |
| 4,850,186 | A | * | 7/1989 | Hiramatsu et al. | 57/236 |
| 5,116,681 | A | * | 5/1992 | Lin | 428/373 |
| 6,045,906 | A | * | 4/2000 | McMahon et al. | 428/364 |
| 2003/0159768 | A1 | | 8/2003 | Fritsch | |

FOREIGN PATENT DOCUMENTS

| | | |
|---|---|---|
| DE | 19932842 | 12/1999 |
| EP | 0303381 A1 | 2/1989 |
| JP | 64-061527 | 3/1989 |
| JP | 02-133632 | 5/1990 |
| WO | WO 02/103097 | 12/2002 |

* cited by examiner

*Primary Examiner*—Shaun R Hurley
(74) *Attorney, Agent, or Firm*—Oliff & Berridge, PLC

(57) ABSTRACT

Thread having at least two strands of continuous carbon fiber that are twisted around one another, whereby the carbon fibers of the strands are arranged approximately parallel to the thread direction. The at least two strands of continuous carbon fiber are twisted around one another and produced by direct cabling. A method for the production of the thread includes twisting each of the at least two strands of continuous carbon fiber around one another by direct cabling. An eyelet assembly with an eyelet that has a radius of at least 4 mm in the area of contact between the strands and the eyelet assembly. The thread is used as a sewing thread or a thread for reinforcing polymers, elastomers, rubber or concrete.

19 Claims, 1 Drawing Sheet

CABLED CARBON-FIBER THREAD

BACKGROUND OF THE INVENTION

1. Field of Invention

The present invention relates to a thread comprising at least two strands of continuous carbon fiber twisted around one another, a process for the production of same, and the uses for this type of thread.

2. Description of Related Art

One of the things needed for the increased manufacture and utilization of textile preforms such as fiber composite materials and filter media, for example for industrial applications is suitable sewing thread. The purpose of these threads is to stabilize the textile preform, but they are also increasingly being used to structurally reinforce it, sometimes at very high temperatures, as are required, for example, for producing fiber ceramics or when using filter media in processes that are subject to high chemical and/or thermal stress.

The mechanical properties and the thermal and chemical stability of carbon fibers make this material particularly suitable for sewing thread, particularly for the aforementioned applications.

The many, mainly forceful thread diversions that occur during sewing damage the thread, and it usually does not achieve its original mechanical stability in the later composite. Brittle carbon fibers in particular can only be sewn under certain conditions. The theoretically attainable mechanical properties of the fibers are not achieved in the component after sewing.

Traditionally, a product made by Toray called Torayca T900 could be sewn only under certain circumstances. This thread is made from 1000 filaments or from two components with 1000 filaments each or three components with 1000 filaments each. The individual components have a twist in the range of S222-225 turns per meter (hereinafter "t/m"). If two or three components are twisted together into strands, these strands are twisted around one another at a twist of approximately Z162-Z164 t/m. Using a normal twisting process with many abrasive thread diversions, it is probably only possible to produce this twisted thread with thin, and thus pliable, filaments that have a diameter of around 5.5 μm or smaller. But it is very costly to produce carbon fibers with a diameter of less than 6 μm, so this type of thread is very expensive.

Alternatively, sewing threads have been developed that have a carbon fiber core and are additionally sheathed by another thread (cf., for example, JP-A 2133632 or JP-A 1061527. Various processes can be used to produce the sheath such as, for example, winding or crocheting around the core. Since the sheathing process is highly stressful for the thread material, polyester or polyamide threads, for example, are used. However, these threads have a low bond strength to the plastic matrix and reduce the volume of carbon fibers in the fiber composite material by the volume of the sheathing thread. Furthermore, the core materials of the sewing threads cannot be seated closely enough to the item being stitched, since the voluminous sheath is situated between them.

Alternatively, twisted glass threads, or aramid or PBO fibers, are used for sewing since they have a greater transverse strength than carbon fibers and so suffer less damage during the abrasive stitching process. But their compressive or mechanical properties in a composite with a matrix such as plastic are considerably more marginal than those of carbon fibers, so they cannot provide true structural reinforcement.

Usually the filaments of filament thread fibers are parallel in the thread after manufacture and do not form a closely integrated thread composite. However, for sewing threads in particular, such a composite is important since this is the only way to ensure that faultless seams are produced.

Twists are introduced to filament threads to produce a closely integrated thread composite. This, usually additional, production step represents an initial damaging of the filaments, which is in turn a source of further filament damage, to the point of the thread tearing, in the subsequent stitching process.

SUMMARY

Therefore, an object of the present invention is to provide threads made of continuous carbon fibers for which the above described disadvantages are at least reduced. In particular, the object is for the threads to be better suited for use as sewing threads than those that have been on the market.

DETAILED DESCRIPTION OF EMBODIMENTS

Figure 1:
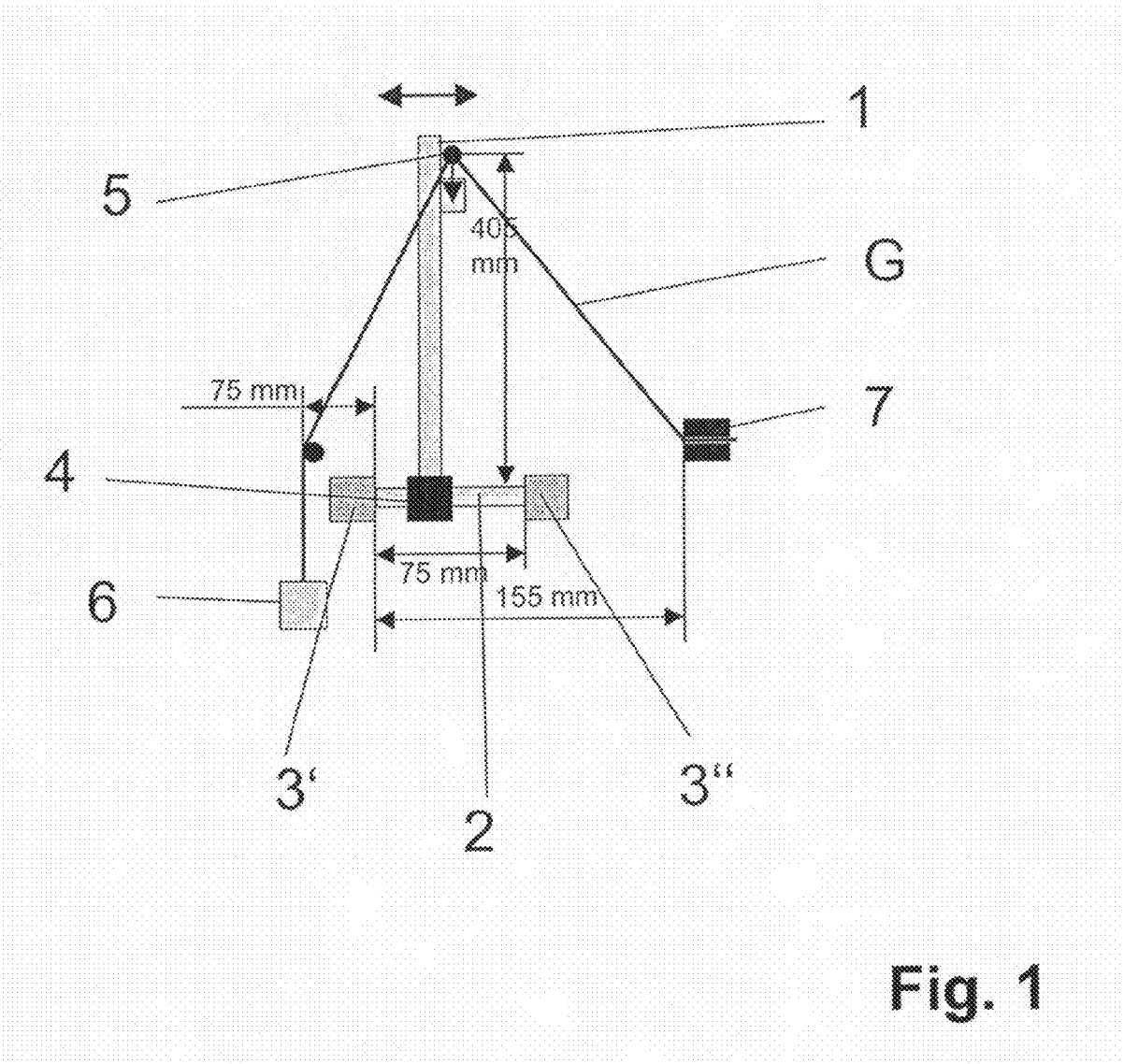
FIG. 1 illustrates a system for measuring thread abrasion resistance.

At least the above object of the invention is achieved by the thread having at least two strands of continuous carbon fiber twisted around one another, whereby the carbon fibers of the strands are arranged at least approximately parallel to the direction of the thread.

For the present invention, carbon fibers are understood to be continuous carbon fibers (carbon fiber filaments). Choosing to arrange the carbon fibers approximately parallel to the thread axis in a single processing step means that the loss of strength produced by twisting strands together in the two-stage twisting process, as a result of filament breaks during the two-phase manufacturing process or the otherwise unavoidable diagonal positioning of the filaments in the thread, is considerably less pronounced in a one-stage twisting process.

The threads of the invention can be produced by the direct cabling of at least two carbon fiber strands. This direct cabling has so far only been used to manufacture tire cord (cf., for example, WO 02/103097). However, the direct cabling machines currently on the market would have to be altered to produce the threads of the invention. In particular, the assembly eyelet through which the strands used to manufacture the thread of the invention are twisted around one another needs to have a radius of at least 4 mm, preferably 4 to 40 mm, particularly preferably at least 6 to 12 mm, in the area where contact is made with the strands. It has also been shown to be particularly advantageous if each of the thread guide elements used in a direct cabling machine has a radius of at least 4 mm, preferably 4 to 40 mm, particularly preferably 6 to 12 mm, in the area in which contact with one or more strands or with the finished thread occurs. If these dimensions are conformed to, the thread of the invention can be manufactured using the knowledge of one skilled in the art of direct cabling.

The surface of the assembly eyelet is coated with a plasma application comprising 97% $Al_2O_3$ and 3% $TiO_2$ that is then polished to a gloss so the carbon fibers can be processed in a way that is particularly protective of the filaments.

With direct cabling, two strands are twisted around one another in one operation without the individual strands being provided with twist. Carbon fibers, in particular, can produce very high thread strength because of their nearly completely extended, parallel filaments. Furthermore, the thread tension in both strands can be set very precisely by means of the cord regulator so that strands of essentially the same length can be twisted around one another. This enables both strands to absorb equal amounts of the total stress and both thread components can be utilized to their fullest.

A further advantage of direct cabling for processing usually brittle carbon fibers is the low number of thread guide elements required for this process, although these elements do have to be adapted to the aforementioned dimensions. This damages the filaments much less than prior art twisting processes.

Tests have shown that carbon fibers with a filament diameter of 5 to 8 microns (hereinafter "μm") and a filament count of 100 to 2000 filaments, preferably 500 to 1000 filaments, are particularly well suited to be the starting material when manufacturing the threads of the invention. With direct cabling, particularly suitable threads that can be used for sewing thread, in particular, are produced if a twist count of 50 to 1000 t/m, preferably 150 to 250 t/m, is set. Twist counts of 150 to 400 t/m, particularly 160 to 290 t/m, have proven particularly successful.

The precursor, that is the fibers that can be processed by means of oxidation and/or carbonization into carbon fibers, can also be directly cabled, after which the oxidation and/or carbonization is done. It is likewise conceivable that all the intermediate products of carbon fiber production could be withdrawn from the process, directly cabled and then fed in again at the step of the carbon fiber production process where they were withdrawn. The intermediate products produced prior to carbonization are particularly well suited for this.

The thread of the invention distinguishes itself in particular by having an average abrasion resistance of 50 to 350, preferably of 175 to 300.

Abrasion resistance is measured as specified in the following method:

to determine thread abrasion resistance, a thread G is clamped in a thread clamp 7 and guided according to the threading sequence in FIG. 1 through a sewing needle 5 and weighted with a weight 6 of 10 g on the other end or a free thread end. During the abrasion test, a traverse 1 with the sewing needle 5 moves cyclically and horizontally over a displacement of approximately 75 mm. The traverse 1 is mounted by a bearing 4 on a guide 2. The displacement of approximately 75 mm is delimited by stops 3' and 3". Approximately 60 strokes are executed per minute.

Since one thread end is secured in the thread clamp, the thread G moves, due to the ever changing distance between yarn clamp 7 and the eye of the needle 5, through the eye of the needle 5 and is exposed in this manner to abrasion stress. After a thread tears, the number of strokes executed up to that point is recorded. This measurement is performed on eight different thread sections. Upon completion of the test, all eight values are averaged and rounded to a whole number. The average abrasion resistance is given as this whole number.

Since the thread, in a manner similar to the stitching process, is frequently guided through the eye of the needle under stress and at a considerable angle, measuring the average abrasion resistance is an excellent way to assess the stitching properties of the tested thread.

The thread of the invention, particularly, distinguishes itself by fulfilling the following condition:

$$S=-35\times10^{-4}D^2+2D-A,$$

whereby

S is the average abrasion resistance,

D is the strand turns per meter and

A ranges between 170 and −35.

The thread of the invention particularly distinguishes itself by fulfilling the following condition:

$$K=-105\times10^{-4}D^2+590D-B$$

whereby

K is the average knot strength in MPa and

D is the strand turns per meter and

B ranges between 250 and 450.

Knot strength is measured in accordance with DIN 53842, except the thread ends are secured with cardboard cap strips before they are clamped in the tension testing machine. In addition, no preload force is set because the material is so brittle.

The thread of the invention is furthermore characterized by the carbon fibers in the strands having a diameter of 3 to 10 μm, particularly 6 to 10 μm.

The invention will now be described in detail with the help of the following examples.

Two carbon fiber strands made of Tenax HTA 5641 67tex f1000 Z15, a thread sold by the Toho Tenax Europe, each with 1000 carbon fiber filaments, were cabled using direct cabling, whereby the strands were cabled at different twist values. The cross-section of the opening of the assembly eyelet is curved where the threads contact the assembly eyelet, whereby the smallest radius of the curve is approximately 15 mm. The thread inlet and outlet areas of the assembly eyelet have a smaller curve radius in the range of 1 to 3 mm. The other thread guides are likewise curved in cross-section, whereby the smallest radius is approximately 8 mm.

The abrasion resistance and knot strength exhibited by the threads produced in this manner are shown in Table 1.

TABLE 1

| Thread | A | B | C | D |
|---|---|---|---|---|
| Applied twists [t/m] | 150 | 200 | 250 | 300 |
| Average abrasion resistance | 106 | 206 | 229 | 190 |
| Knot strength [MPa] | 234.6 | 441.6 | 467.3 | 405.4 |

The table shows that threads B and C produce the best results in terms of abrasion resistance and knot strength. They are therefore optimally suited as sewing threads.

In addition to the actual sewing properties of a thread, the fiber-matrix bond, primarily in the area of a seam, is particularly important to the mechanical potential of the material, especially for the three-dimensional reinforcement of fiber composite materials. To demonstrate the strength of the fiber-matrix bond without disruptive influences (such as from a stitching process), a prepreg was prepared from threads B and C in combination with a resin film, the compressive strength was measured in accordance with EN 2850-B2 and the apparent interlaminar shear strength was measured in accordance with EN 2563.

The following steps were completed to conduct the test:

apply a prepreg film (Hexcel Composite (Dagneux, France) HexPly 6376 prepreg film) with a weight per unit area of 72 g/m$^2$ onto a metallic winding body that in cross-section has an octagonal shape, with each side having a length of 100 mm;

wrap the thread perpendicular to the wrapping axis onto this film with a laboratory-scale wrapping apparatus at a thread tension of 500 cN and a wrapping speed of 23.1 mm/s in such a way that a unidirectional (hereinafter "UD") structure is produced;

wrap a new prepreg film with a weight per unit area of 72 g/m$^2$ around the layers;

heat this entire UD structure and the metallic core in an oven, while rotating constantly, to 80° C. over 20 minutes;

continue to heat the UD structure at 80° C. for 20 minutes and cool back to room temperature over 60 minutes; and cut open the resulting UD body at the eight edges to produce 8 rectangular prepreg materials.

These prepreg materials are further processed in accordance with the EN 2850-B2 and EN 2563 standards into multilayer laminates in an autoclave and a conventional vacuum structure and tested at standard atmospheric conditions.

For comparison, additional multilayer laminates were prepared in this same manner, whereby the following threads were produced:

- a carbon fiber thread E (Tenax HTA 5131 400tex f6000 t0, a thread available from the applicant),
- carbon fibers F (Tenax HTA 5641 67tex f1000 Z15) sheathed in crocheted polyester fibers (PES 84 dtex f12) and
- PBO fibers G made from poly(p-phenylene-2,6-benzobisoxazole) fiber, trade name Zylon PBO Fiber, manufactured by Toyobo, Osaka, Japan.

The test results for the apparent interlaminar shear strength (ILSS) according to EN 2563 and the results of the compressive strength test according to EN 2850-B2 are listed in Table 2.

TABLE 2

| | Thread | | | | |
|---|---|---|---|---|---|
| | B | C | E | F | G |
| Fiber volume percentage [%] | 57.2 | 56.2 | 59.0 | 38.5 | 66.9 |
| Apparent interlaminar shear strength [MPa] | 123.2 | 120.5 | 113.3 | 50.5 | 40.3 |
| Compressive strength [MPa] | 1118.6 | 989.1 | 1215.6 | 383.3 | 178.6 |

It is clearly evident that threads B and C of the invention have a high apparent interlaminar shear strength and a compressive strength similar to a conventional carbon fiber thread E. The filaments of the thread are not diverted substantially from their orientation parallel to the thread's longitudinal axis by the cabling operation of the invention, since the resulting compression data would have been lower.

In contrast, the reference thread F, which has a core of carbon fiber filaments and a crocheted sheath of polyester thread, has substantially inferior compressive strength values. In other words, the load-absorbing carbon fiber filaments are no longer extended along the thread's longitudinal axis, so they fail more quickly if exposed to compressive stress. Furthermore, the polyester sheath prevents the required adhesion between load absorbing carbon fibers and the matrix material.

While the second reference thread G has excellent sewing properties due to its high transverse strength and ductility, it has very low shear and compressive strengths and, as a result, cannot be expected to reinforce fiber composite materials.

To illustrate the advantage of sewing fiber composite materials specifically for impact loads, test pieces were produced and tested in accordance with EN 6038. In deviation from EN 6038, the produced test pieces have a wall thickness of 4 mm, while the test was undertaken with a span of 15 mm. Four layers of quasi-isotropic, 4-ply multiaxial composite (NCF, 267 g/m$^2$ fiber weight per unit area of the composite fabric single ply) are sewn together for the test. The sewing is done with the aforementioned thread C at a stitch length of 4 mm, a seam spacing of 3 mm and with an extended underthread (also thread C) using a lock stitch.

The textile preform produced in this manner, with a base area of 315 mm$^2$ and a wall thickness of 4 mm, is impregnated with Hexcel RTM6 resin according to the resin manufacturer's instructions to produce a non-porous fiber composite material with a fiber volume percentage of 60±4%. Test pieces were sawn out of this plate and tested in accordance with the EN 6038 testing standard (hereinafter "NCF stitched").

Corresponding test pieces were produced with the help of the aforementioned multiaxial composite (four 4-ply layers) without stitching (hereinafter "NCF unstitched") and with the help of an analogously constructed prepreg laminate (16 layers, each with 267 g/m$^2$ fiber weight per unit area for the prepreg individual layers), mirror-symmetrically to the middle layer made of resin film (HexPly 6376 by Hexcel Composite, Dagneux, France) and carbon fibers (Tenax HTS 5631 800tex fl2000 t0 of the applicant) (hereinafter "prepreg").

Table 3 shows the results of the test (residual compressive strength after impact stress in accordance with EN 6038 in [MPa]) with the thread of the invention (NCF stitched) compared to an unstitched multiaxial composite (NCF unstitched) and an analogously constructed laminate (prepreg).

TABLE 3

| Impact energy [J] | Prepreg | NCF unstitched | NCF stitched |
|---|---|---|---|
| 0 | 342.9 | 305.2 | 290.6 |
| 20 | 208.1 | 209.6 | 265.1 |
| 30 | 196.9 | 172.8 | 253.6 |
| 40 | 160.4 | 139.9 | 267.0 |

It is clear that, especially at higher impact energy, the stitching helps produce a nearly constant series of residual compressive strength values. In contrast, the conventional unstitched reference laminates show that the residual compressive strength is highly dependent on the previously introduced impact energy. Accordingly, so far components without stitching have had to be dimensioned sufficiently larger, and thus heavier, to combat this type of stress.

The thread of the invention can be utilized in practically any matrix that can be reinforced with fibers. Polymers, such as thermoplasts (e.g., polyethylene imine, polyetherketone, polyetheretherketone, polyphenylene sulfide, polyethersulfone, polyetherethersulfone, polysulfone), duromers (e.g., epoxides), elastomers, and rubber can be used as matrix materials. Carbon fibers can be utilized in ceramic materials (e.g., silicon carbide or boron nitride) or metallic materials (e.g., steel, steel alloys, titanium) because of their excellent temperature resistance. Thermoplasts and duromers are especially well-suited for this since the necessary fiber-matrix bond between these polymer materials and the carbon fibers is especially good.

Reinforcing elastomers and rubber with the thread of the invention is likewise advantageous since carbon fibers are normally very strong but they do not have the elastic properties typical of these materials. The thread structure of the threads of the invention improves elasticity, making them better for reinforcing elastomer and rubber materials as well.

For example, direct cabling of carbon fibers can be used both for the manufacture of sewing threads and for the manufacture of threads for concrete reinforcement. If strands are selected for direct cabling and one of these strands has a higher tensile strength than the other, for example, the strand or strands with the lower tensile strength wraps itself around the strand or strands with the higher tensile strength. This produces a thread with a kind of ribbing, like that on steel reinforcing bars for concrete. This feature makes it possible to anchor the thread in the concrete.

Various components could be of interest for this thread construction. For the core, which comprises one or more extended strands, carbon fibers with a filament count of more than 6000 filaments, preferably having more than 24,000 filaments, are suitable. Finer threads, which do not necessarily have to be made of carbon fibers, lend themselves for use as the outer strand or strands. The twist value should be on the order of very few turns per meter, preferably fewer than 10 t/m.

The invention claimed is:

1. A thread comprising at least two strands of continuous carbon fibers, wherein each individual strand is comprised of a plurality of carbon fibers that are not twisted around one another, the at least two strands being twisted around one another, wherein the at least two strands are twisted around one another at 150 to 400 turns per meter, whereby the carbon fibers of the strands are arranged at least approximately parallel to a thread direction.

2. A thread comprising at least two strands of continuous carbon fibers, wherein each individual strand is comprised of a plurality of carbon fibers that are not twisted around one another, the at least two strands being twisted around one another, wherein the thread is produced by direct cabling of the at least two strands and wherein the at least two strands are twisted around one another at 150 to 400 turns per meter.

3. The thread according to claim 1, wherein the at least two strands are twisted around one another at 160 to 290 turns per meter.

4. The thread according to claim 1, wherein the thread has an average abrasion resistance of 50 to 350.

5. The thread according to claim 4, wherein the thread has an average abrasion resistance of 175 to 300.

6. The thread according to claim 1, wherein the following condition is fulfilled:

$$S=-35\times10^{-4}D^2+2D-A, \text{ wherein}$$

S is the average abrasion resistance,

D is the strand turns per meter and

A ranges between 170 and −35.

7. The thread according to claim 1, wherein the following condition is fulfilled:

$$K=-105\times10^{-4}D^2+590D-B$$

wherein

K is the average knot strength in Mpa,

D is the strand turns per meter and

B ranges between 250 and 450.

8. The thread according to claim 1, wherein the carbon fibers in the strands have a diameter of 6 to 10 μm.

9. The thread according to claim 1, wherein the thread is a sewing thread.

10. A method for production of the thread according to claim 1 wherein each individual strand is comprised of a plurality of carbon fibers that are not twisted around one another and wherein the at least two strands of continuous carbon fibers are twisted around one another by direct cabling, and wherein the at least two strands are twisted around one another at 150 to 400 turns per meter, comprising:

providing an assembly eyelet having an eyelet that has a radius of at least 4 mm in an area of contact between the strands and the assembly eyelet, and feeding the strands to the eyelet for the direct cabling.

11. The method according to claim 10, wherein the assembly eyelet is an eyelet that has a radius of 4 to 40 mm at least in the area of contact between the strands and the assembly eyelet.

12. The method according to claim 10, wherein the assembly eyelet is an eyelet that has a radius of 6 to 12 mm at least in the area of contact between the strands and the assembly eyelet.

13. The method according to claim 10, wherein thread guides are used that have a radius of at least 4 mm, at least in the area of contact between the strands and the thread guides.

14. The method according to claim 13, wherein the thread guides have a radius of at least 4 to 40 mm, at least in the area of contact between the strands and the thread guides.

15. The method according to claim 13, wherein the thread guides have a radius of at least 6 to 12 mm, at least in the area of contact between the strands and the thread guides.

16. The thread according to claim 2, wherein the thread is a sewing thread.

17. A composite comprising (a) a matrix material comprising thermoplasts, duromers, elastomers, rubber, or ceramic materials, and (b) the thread according to claim 1.

18. A concrete including, as a reinforcement material, the thread according to claim 1.

19. The thread according to claim 1, wherein each strand comprises from 100 to 2,000 carbon fibers.

* * * * *